United States Patent [19]

McFadden

[11] 4,021,971

[45] May 10, 1977

[54] MULTI-DRUM GEM TUMBLER

[76] Inventor: Roy W. McFadden, 1202 Ennis, Plainview, Tex. 79072

[22] Filed: Feb. 12, 1976

[21] Appl. No.: 657,632

[52] U.S. Cl. ..... 51/164

[51] Int. Cl.[2] ..... B24B 31/02

[58] Field of Search ..... 51/164; 241/175

[56] References Cited

UNITED STATES PATENTS

| | | | |
|---|---|---|---|
| 2,476,078 | 7/1949 | Banks | 51/164 |
| 2,606,407 | 8/1952 | Banks et al. | 51/164 |
| 3,374,584 | 3/1968 | Haught | 51/164 |
| 3,474,574 | 10/1969 | Ohno | 51/164 |

*Primary Examiner*—Harold D. Whitehead
*Attorney, Agent, or Firm*—Clarence A. O'Brien; Harvey B. Jacobson

[57] ABSTRACT

A motor driven, slowly turning and horizontally disposed rotary support shaft is provided and a hollow tubular receiver is supported from the shaft for rotation therewith. The receiver is positioned in spaced relation outwardly of one side of the shaft and extends longitudinally of the latter. A resilient deformable drum is removably supported within the receiver and the drum includes an access opening for the entrance of stones to be tumbled into the drum and the discharge of tumbled stones therefrom, a removable closure being provided for the access opening. A plurality of tubular receivers and associated resilient drums may be supported from and spaced about the shaft and the shaft is of a length to have a plurality of sets of circumferentially spaced receivers and associated drums spaced longitudinally of the shaft.

4 Claims, 5 Drawing Figures

10
12
14
18
20
22
24
26
28
30
32
34
36
38
40
42
44
46
48
50
52
54
56
58
60
62
64
66
70
72
74
75
76
78
80
82
84

MULTI-DRUM GEM TUMBLER

BACKGROUND OF THE INVENTION

Various forms of tumbling devices for polishing and tumbling stoneshave been heretofore designed. However, most of these devices have not been constructed in a manner whereby various batches of stones may be individually tumbled and whereby individual batches of stones may be tumbled for different time periods.

Examples of previously patented tumbling devices including some of the general structural and operational features of the instant invention are disclosed in U.S. Pat. Nos. 1,840,429, 3,769,758 and 3,813,816.

BRIEF DESCRIPTION OF THE INVENTION

The gem tumbler of the instant invention includes a main horizontal slowly turning motor driven shaft including circumferentially and longitudinally spaced support shank portions from which an equal number of hollow cylindrical receivers extending longitudinally of the shaft and spaced outwardly of the latter may be supported. Each of the receivers has a resilient drum removably supported therein and each drum may be utilized to contain a separate batch of gems to be tumbled, thereby enabling the tumbling time of each batch of stones to be varied and other batches of stones to be added to the total number of batches being tumbled.

The main object of this invention is to provide a gem stone tumbler constructed in a manner whereby a plurality of separate batches of gem stones may be tumbled at the same time.

Another object of this invention is to provide a gem stone tumbling apparatus in accordance with the preceding object and constructed in a manner whereby resilient drums for containing gem stones to be tumbled may be supported from the main rotary shaft of the apparatus without the resilient drums being deformed from their desired cylindrical configuration as a result of a gem stone tumbling operation.

Another important object of this invention is to provide a gem stone tumbling apparatus constructed in a manner whereby a drum for tumbling gem stones may be orbited about a horizontal axis while the gem stone containing drum is maintained in a horizontal attitude.

A final object of this invention to be specifically enumerated herein is to provide a gem stone tumbler constructed in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
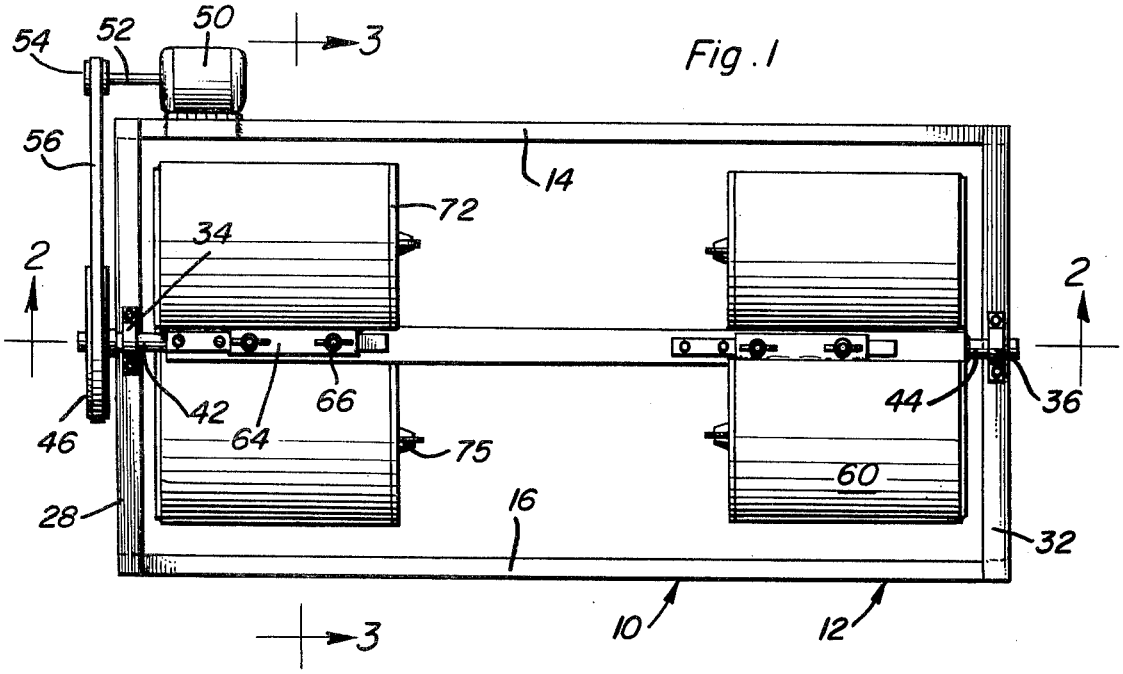
FIG. 1 is a top plan view of the multi-gem drum tumbler of the instant invention.
Figure 3:
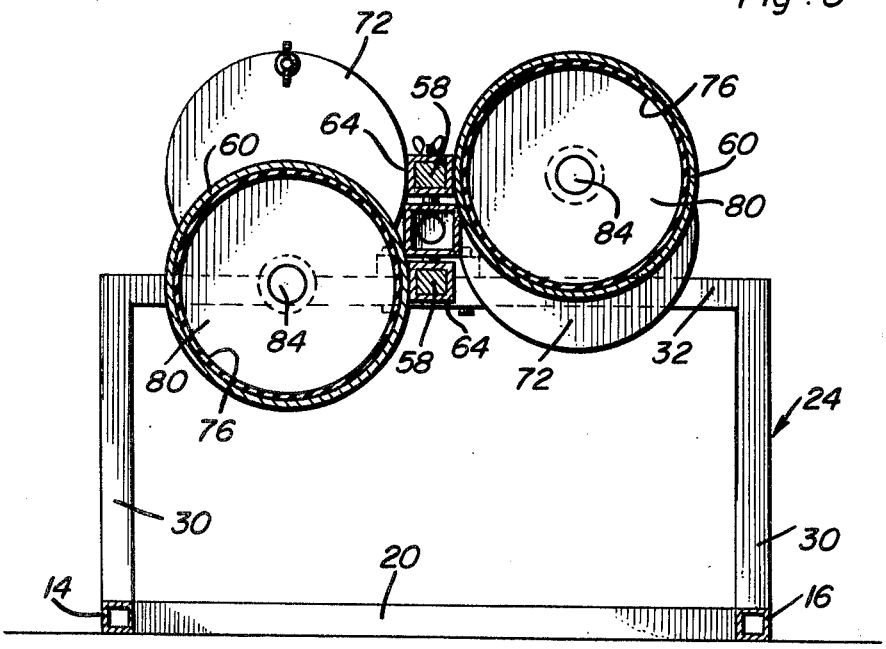
FIG. 3 is an enlarged transverse vertical sectional view taken substantially upon the plane indicated by the section line 3—3 of FIG. 1.
Figure 5:
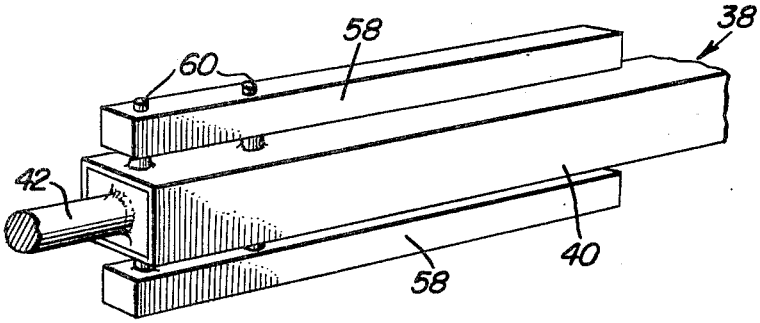
FIG. 5 is a fragmentary perspective view of one end of the main support shaft of the tumbler.
Figures 2, 4:
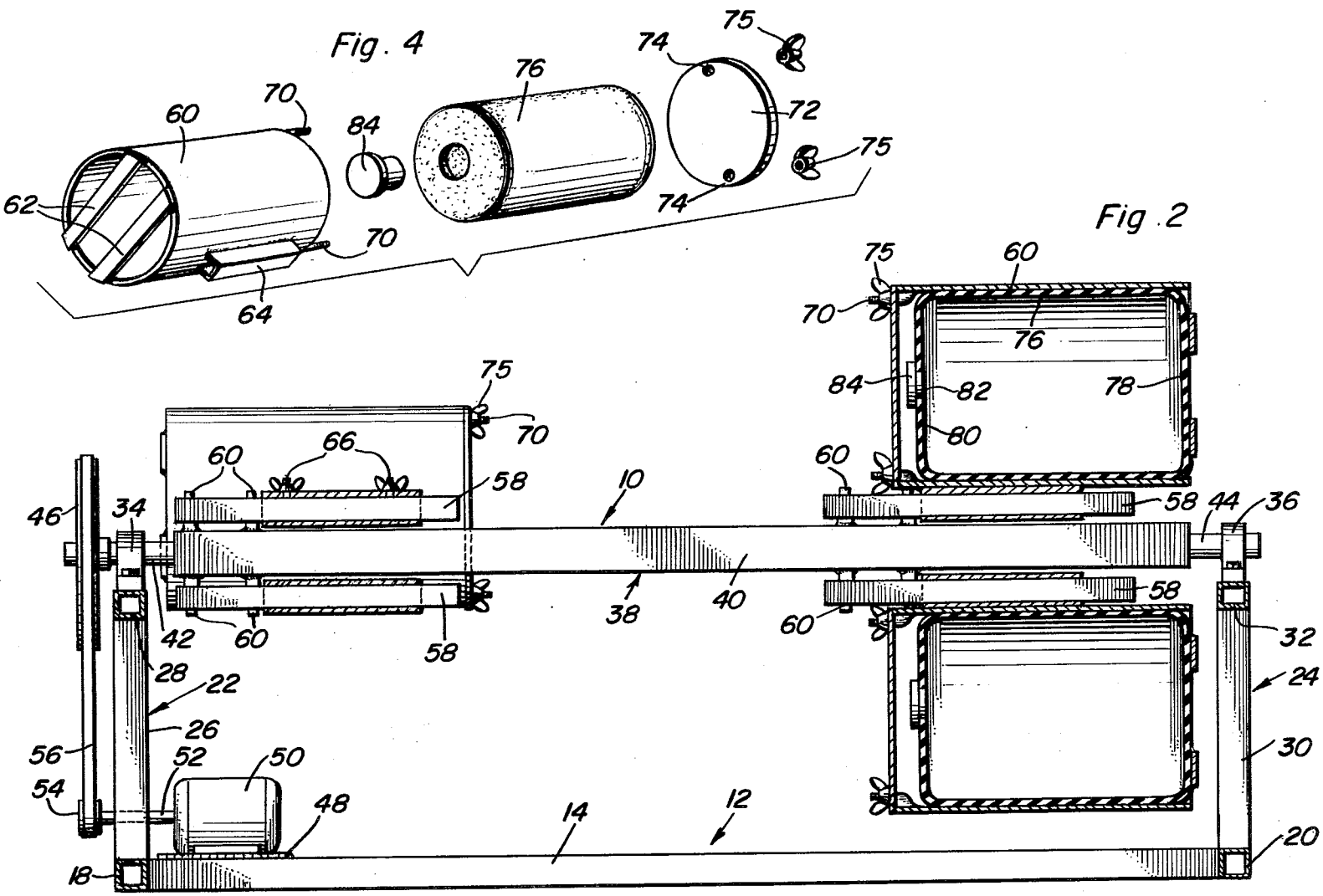
FIG. 2 is an enlarged fragmentary longitudinal vertical sectional view taken substantially upon the plane indicated by the section line 2—2 of FIG. 1.
FIG. 4 is an exploded perspective view of one of the resilient tumbling drum receivers of the tumbler, the associated tumbling drum and the removable cover plate for the receiver.

Referring now more specifically to the drawings, the numeral 10 generally designates the gem tumbler of the instant invention. The tumbler 10 includes a lower horizontal base frame referred to in general by the reference numeral 12 including a pair of opposite side longitudinal members 14 and 16 interconnected at corresponding end portions by means of opposite end transverse brace members 18 and 20. In addition, the opposite ends of the frame 12 include inverted U-shaped supports referred to in general by the reference numerals 22 and 24. The support 22 includes a pair of opposite side depending legs 26 interconnected at their upper ends by means of an upper horizontal bight portion 28 extending and secured therebetween. The lower ends of the legs 26 are secured to the corresponding ends of the longitudinal members 14 and 16 and the inverted U-shaped support 24 includes a pair of depending legs 30 interconnected at their upper ends by means of a horizontal bight portion 32 extending and secured therebetween, the lower ends of the legs 30 being secured to the corresponding ends of the longitudinal members 14 and 16.

The central portions of the bight portions 28 and 32 have a pair of aligned journal blocks 34 and 36 supported therefrom and an elongated shaft assembly referred to in general by the reference numeral 38 is journaled from the journal blocks 34 and 36. The shaft assembly 38 includes a center tubular longitudinal section 40 and a pair of opposite end stub shaft portions 42 and 44 projecting endwise outwardly of the center section 40 and journaled in the journal blocks 34 and 36. The free end of the stub shaft portion 42 projects through the journal block 34 and has a large diameter pulley wheel 46 mounted thereon. A mounting plate 48 extends between and is supported from the ends of the longitudinal members 14 and 16 adjacent the inverted U-shaped support 22 and an electric motor 50 is supported from the plate 48 and includes a rotatable output shaft 52 upon which a small diameter pulley wheel 54 is mounted. The pulley wheel 54 is aligned with the pulley wheel 46 and an endless flexible belt 56 drivingly connects the pulley wheel 54 to the pulley wheel 46.

A pair of square support shank portions 58 are supported on opposite sides of each end of the center section 40 and in spaced relation relative to the latter with the shank portions 58 extending longitudinally of the center section 40. The shank portions 58 are supported from the center section 40 by means of mounting and spacing fastener members 59 and the ends of the shank portions 58 projecting toward the stub shaft portion 44 are free of contact with and spaced from the center section 40.

Four cylindrical receivers 60 are provided and each receiver 60 has one end thereof closed by means of a pair of transverse bars 62. In addition, each receiver 60 includes an outer longitudinal sleeve portion 64 supported therefrom and extending longitudinally thereof. Each sleeve portion 64 is telescopingly receivable upon one of the corresponding support shank portions 58 and includes thumb nut head equipped set screws 66 whereby the sleeve portions 64 may be frictionally retained on corresponding shank portions 58.

The end of each receiver 60 remote from the bars 62 thereof includes a pair of endwise outwardly projecting threaded studs 70 and a circular closure plate 72 having diametrically opposite apertures 74 formed therethrough is provided for each receiver 60 on the end thereof remote from the corresponding bars 62. The threaded studs or fasteners 70 may be received through the apertures or bores 74 and thumb nuts 75 may be threadedly engaged on the threaded studs 70 in order to releasably retain the circular closure members 72 in position on the ends of the receivers 60 remote from the bars 62 thereof.

A deformable resilient cylindrical drum 76 is provided for and snugly removably receivable in each receiver 60 after the cover or closure plate 72 thereof has been removed. One end of each drum 76 includes an imperforate end wall 78 adapted to abut the inner surfaces of the corresponding bars 62 and the other end of each drum 76 is provided with a end wall 80 having a central opening 82 formed therein closed by means of a removable plug 84.

In operation, the plug 84 of each drum 76 may be removed and gem stones to be tumbled may be admitted into that drum 76 after which the plug 84 is replaced. Then, the drum 76 is telescoped into the corresponding receiver 60 and the closure plate or cover 72 is secured in position. After the desired number of drums 76 have been mounted on the shaft structure 38 by means of the receivers 60, the sleeve portions 64 and the support shank portions 58, the electric motor 50 is actuated and operates to slowly turn the shaft assembly 38.

It will, of course, be noted that the drums 76 do not rotate about their center longitudinal axes. Rather, they orbit about the shaft assembly 38 and it has been found that such orbiting motion is more desirable than a simple coaxial rotation of the drum.

In view of the foregoing, it may be seen that a plurality of batches of gem stones to be tumbled may be tumbled in the four drums 76 of the tumbler 10. In addition, if one of the batches of gem stones is to be tumbled only a short time, the operation of the motor 50 may be terminated at the end of that time and the drum containing the gem stones to be tumbled a short time may be removed and replaced by another similar tumbler containing a fifth batch of gem stones to be tumbled. Thereafter, the motor 50 may again be actuated.

The receivers 60 are mounted on the shaft assembly 38 in diametrically opposite pairs and the pairs of receivers are supported from opposite end portions of the shaft assembly 38. Further, the speed of rotation of the shaft assembly 38 may be governed either by a variable speed control for the motor 50 or by changing the pulleys 54 and 46 for similar pulleys of different diameters.

Inasmuch as the receivers 60 and drums 76 are equally spaced about the shaft assembly 38 and thus retain the balance of the shaft asembly 38, the latter may be powered by a lower power motor.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A gem tumbler including a motor driven, slowly turning horizontal support shaft, a plurality of hollow receivers supported from and spaced about said shaft for rotation therewith, a plurality of cylindrical, deformable and resilient drums removably and snugly received within said receivers and supported therefrom against deformation, said drums generally paralleling said shaft and including means defining access openings therein for the entrance of material to be tumbled in said drums and the discharge of tumbled material therefrom, a removable closure for each of said access openings, said shaft including a plurality of outwardly offset support shank portions extending longitudinally thereof with each shank portion having at least one free end, said receivers including sleeve means removably endwise telescoped over said free ends of said support shank portions and releasably anchored thereto.

2. The combination of claim 1 wherein said tumbler includes a plurality of longitudinally spaced sets of tumbler supporting receivers with the receivers of each set spaced about said shaft.

3. The combination of claim (1) wherein each of said receivers comprises a hollow cylindrical body in which the corresponding drum is received.

4. The combination of claim 3 wherein each body includes abutment means at one end against which one end of the corresponding drum may abut and removable closure means at the other end for providing access to the interior of said receiver when said removable closure means is removed.

* * * * *